US006530354B1

(12) United States Patent
Bishop et al.

(10) Patent No.: US 6,530,354 B1
(45) Date of Patent: Mar. 11, 2003

(54) OIL PAN WITH VERTICAL BAFFLES

(75) Inventors: Thomas M. Bishop, Richmond, MI (US); John A. Holzerland, Royal Oak, MI (US); Stanley P. Nunes, St Clair Shores, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/078,202

(22) Filed: Feb. 19, 2002

(51) Int. Cl.[7] ..... F02F 7/00
(52) U.S. Cl. ..... 123/195 C; 184/106
(58) Field of Search ..... 123/195 C; 184/106

(56) References Cited

U.S. PATENT DOCUMENTS 1,200,172 A * 10/1916 Danver ..... 184/106
5,960,763 A * 10/1999 Yamamura ..... 123/195 C
6,244,237 B1 * 6/2001 Sayama et al. ..... 123/192.2

* cited by examiner

*Primary Examiner*—Noah P. Kamen
(74) *Attorney, Agent, or Firm*—Leslie C. Hodges

(57) ABSTRACT

An oil pan for use with an engine having a crankshaft includes a pan body adapted to be disposed beneath the crankshaft for receiving oil that is exhausted from the engine. The oil pan further includes a vertically extending baffle attached to the pan body.

5 Claims, 3 Drawing Sheets

OIL PAN WITH VERTICAL BAFFLES

TECHNICAL FIELD

The invention relates to an oil pan for use with an engine.

BACKGROUND OF THE INVENTION

A typical oil pan is disposed beneath a cylinder block and crankshaft of an internal combustion engine. Such an oil pan is configured to receive oil that drains or is otherwise exhausted from the cylinder block, crankshaft and/or main bearings that support the crankshaft. The oil collects in a sump of the oil pan, and is then pumped from a sump pick-up location into a lubrication system associated with the engine. The oil pan may also be provided with a horizontal baffle that inhibits oil from moving away from the pick-up location during "high G" maneuvers, such as sudden brake and/or acceleration events.

During operation of the engine, some oil that would otherwise drain into the oil pan may instead become entrained in crankshaft windage, which is air that rotates with the crankshaft. To address this situation, the engine may be provided with one or more oil scrapers that are attached to the main bearing caps with fasteners.

SUMMARY OF THE INVENTION

Under the invention, an oil pan for use with an engine having a crankshaft includes a pan body adapted to be disposed beneath the crankshaft for receiving oil that is exhausted from the engine. The oil pan further includes a vertically extending baffle attached to the pan body.

In one embodiment of the invention, the baffle is adapted to scrape oil from crankshaft windage associated with the crankshaft. In addition or as an alternative, the baffle may cooperate with the pan body to define a channel for receiving oil, and the baffle may be configured to shield oil in the channel from crankshaft windage. Furthermore, the baffle may be integrally formed with the pan body.

The oil pan may further include an additional baffle attached to the pan body. With such a configuration, the baffles may cooperate with the pan body to define first and second outer channels and an inner channel disposed between the outer channels.

Further under the invention, an oil pan is provided for use with an engine having a crankshaft, wherein the crankshaft produces crankshaft windage when the crankshaft rotates. The oil pan includes a pan body adapted to be disposed beneath the crankshaft for receiving oil that is exhausted from the engine. The pan body has a floor and side walls that cooperate with the floor to define a shallow portion and a deep portion in fluid communication with the shallow portion. The oil pan also includes first and second vertically extending baffles disposed at least partially in the shallow portion of the pan body and attached to the floor. The baffles are spaced apart from each other so as to define first and second outer channels and an inner channel disposed between the outer channels. The first baffle is adapted to scrape oil from the crankshaft windage, and the second baffle is adapted to shield oil in the second outer channel from the crankshaft windage.

DESCRIPTION OF THE PREFERRED EMBODIMENT

Figure 1:
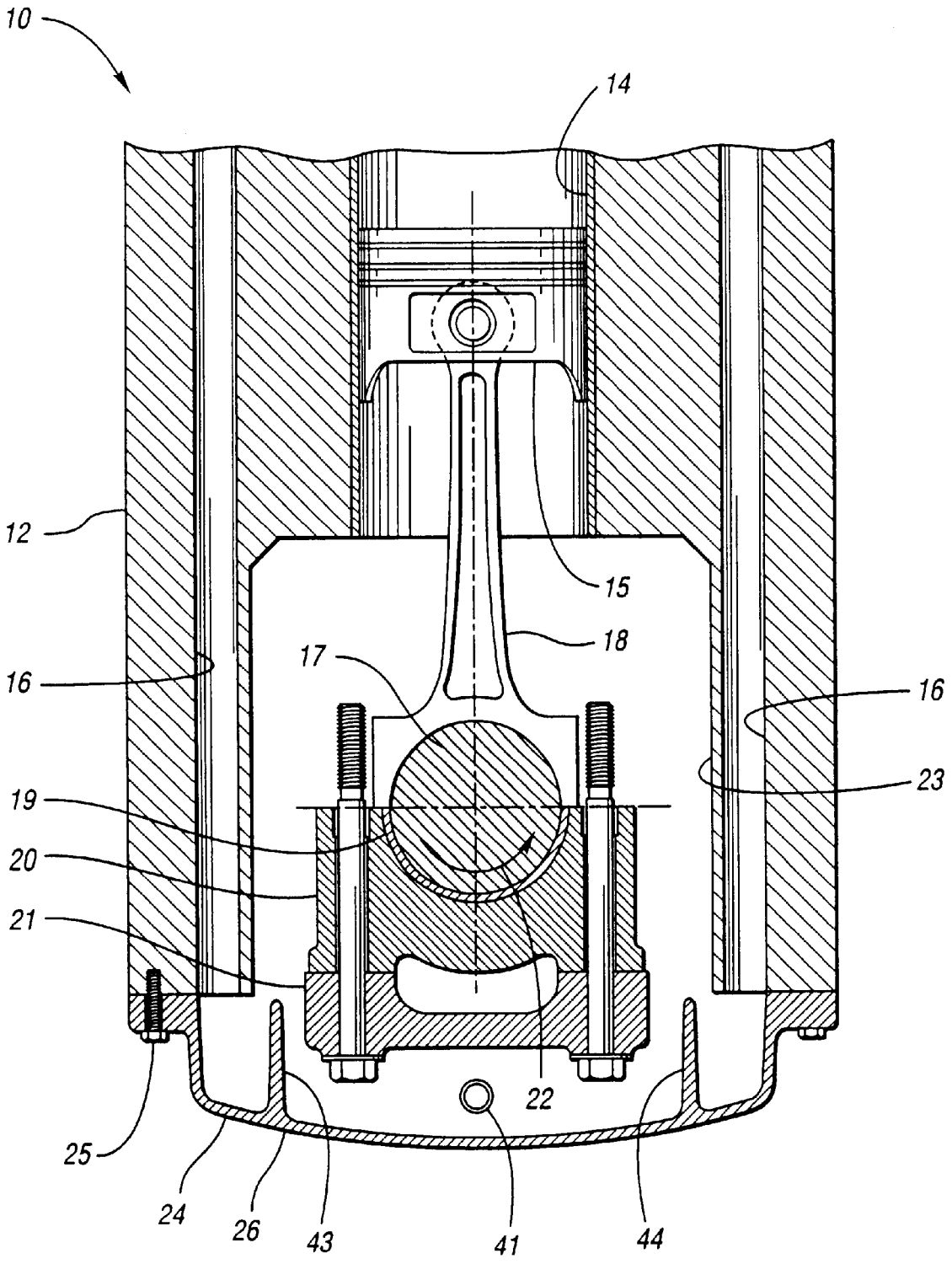
FIG. 1 is a cross-sectional view of an engine viewed from a rear portion of the engine toward a front portion of the engine, wherein the engine includes an oil pan according to the invention.

FIG. 1 shows an engine 10 including a cylinder block 12 having a plurality of cylinders 14 that house a plurality of pistons 15. The cylinder block 12 further includes multiple drain passages 16 that drain oil from one or more cylinder heads (not shown) and/or from other portions of the cylinder block 12.

The engine 10 also includes a crankshaft 17 that is connected to the pistons 15 with connecting rods 18. The crankshaft 17 is supported by crankshaft bearings or main bearings 19, which are supported by bearing cap 20 and bearing beam 21. The crankshaft 17 is rotatable with respect to the cylinder block 12 so as to cause the pistons 15 to reciprocate in the cylinders 14. In the embodiment shown in FIG. 1, for example, the crankshaft 17 rotates in a first direction, such as counterclockwise direction 22. Rotating motion of the crankshaft 17 in crank case 23 causes air to rotate with the crankshaft 17. This rotating air may be referred to as crankshaft windage.

Figure 2:
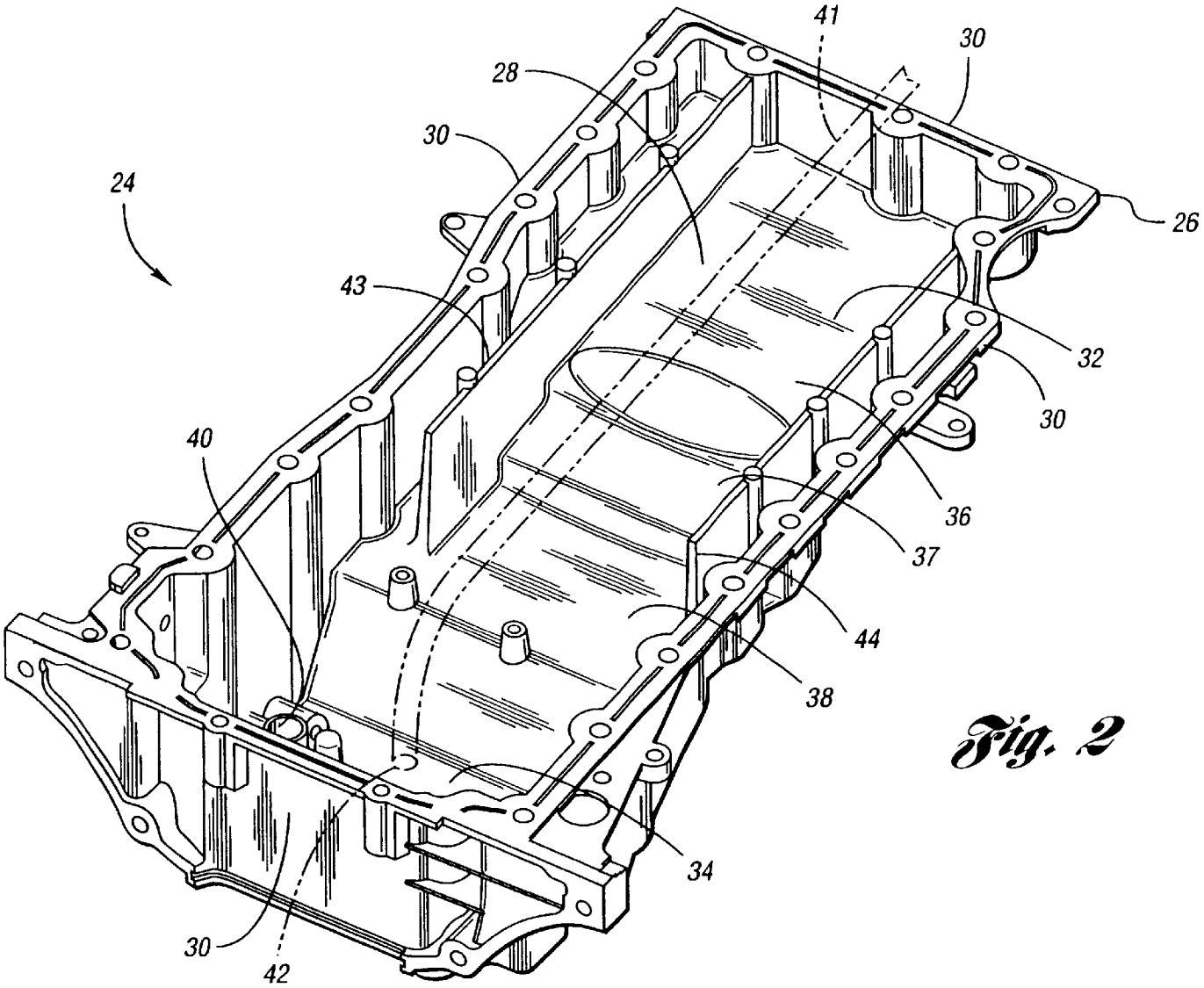
FIG. 2 is a perspective view of the oil pan including a pan body and first and second vertically extending baffles attached to the pan body.
Figure 3:
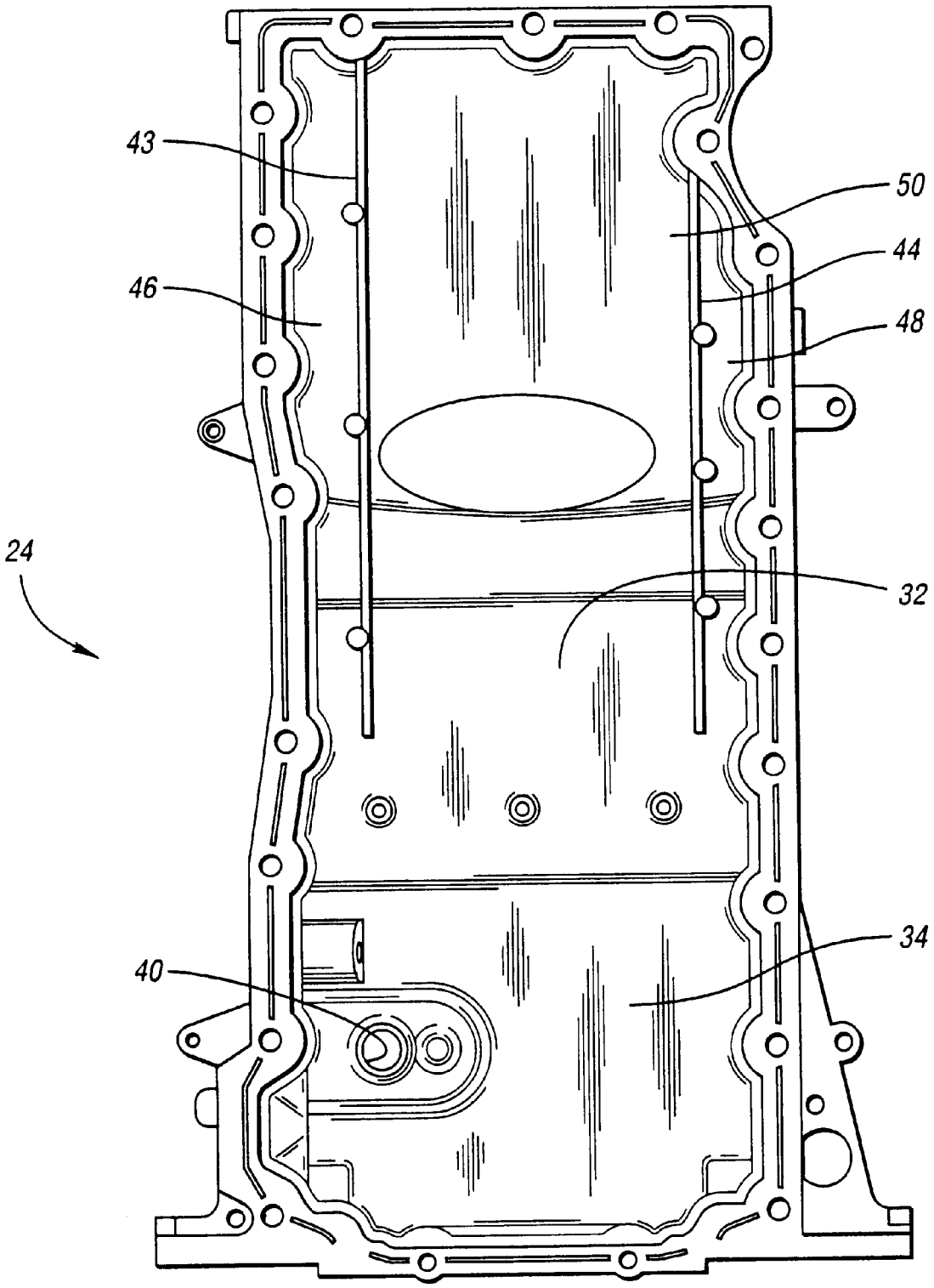
FIG. 3 is a top view of the oil pan.

The engine 10 further includes an oil pan 24, according to the invention, disposed beneath the crankshaft 17 for receiving oil that is exhausted from the crankshaft 17, main bearings and/or cylinder block 12. In the embodiment shown in FIG. 1, the oil pan 24 is attached directly to the cylinder block 12 with fasteners 25. Referring to FIGS. 1–3, the oil pan 24 includes a pan body 26 having a floor 28 and sidewalls 30. The sidewalls 30 cooperate with the floor 28 to define a shallow portion 32 and a deep portion 34, which may be referred to as a sump, in fluid communication with the shallow portion 32. The shallow portion 32 may be disposed beneath a front portion of the crankshaft 17, and the deep portion 34 may be disposed beneath a rear portion of the crankshaft 17. Each of the portions 32 and 34 may also have multiple levels. In the embodiment shown in FIG. 2, for example, the shallow portion 32 includes first, second and third levels 36, 37 and 38, respectively. In addition, the deep portion 34 may include an aperture 40 for receiving an oil level sensor (not shown).

An oil pick-up tube 41 extends from an oil pump (not shown) into the oil pan 24 for drawing oil from the oil pan 24. The tube 41 terminates at an oil pick-up location 42 disposed proximate the floor 28 in deep portion 34.

The oil pan 24 further includes first and second vertically extending baffles 43 and 44, respectively, disposed in the shallow portion 32 and attached to the floor 28. As shown in FIG. 1, the baffles 43 and 44 may extend substantially the entire height of the shallow portion 32. Furthermore, the baffles 43 and 44 may be attached to the floor 28 in any suitable manner, such as with fasteners and/or weld joints. As another example, the baffles 43 and 44 may be integrally formed with the pan body 26.

The baffles 43 and 44 are spaced apart from each other so as to define first and second outer channels 46 and 48, respectively, and an inner channel 50 disposed between the outer channels 46 and 48. The first baffle 43 is configured to scrape or otherwise remove oil from the crankshaft windage, and then direct this oil along the first outer channel 46 and into the deep portion 34. The first baffle 43 also shields oil in first outer channel 46 from the crankshaft windage, and inhibits such oil from becoming entrained in the crankshaft windage.

The second baffle 44 is configured to sufficiently inhibit crankshaft windage from entering drain passages 16 disposed on the right side of the cylinder block 12 (as viewed from the rear of the engine 10), such that oil in these drain passages 16 may sufficiently drain into the second outer channel 48. The second baffle 44 is also configured to shield oil in the second outer channel 48 from the crankshaft windage, so that such oil may drain into the deep portion 34. The second baffle 44 may also scrape or otherwise remove oil from the crankshaft windage.

The oil pan 24 may be manufactured in any suitable manner and may comprise any suitable material. For example, the oil pan 24 may be made of cast aluminum. The oil pan 24 may also be subjected to one or more machining operations so as to further define various features of the oil pan 24.

The oil pan 24 of the invention provides several benefits over prior designs. First, because one or both of the baffles 43 and 44 may be configured to remove entrained oil from crankshaft windage, shield oil from crankshaft windage and/or inhibit crankshaft windage from entering the drain passages 16 in the cylinder block 12, the baffles 43 and 44 enable more oil to collect in the deep portion 34, as compared with prior oil pans. As a result, sufficient oil will typically be present proximate the oil pick-up location 43 even during "high G" maneuvers, such as sudden brake and/or acceleration events, thereby improving lubrication system performance. In addition, because of increased oil in the deep portion 34, oil temperature may be reduced, thereby increasing oil life.

Second, because the oil pan 24 effectively separates entrained oil from crankshaft windage, oil aeration is reduced and oil quality is increased compared with prior arrangements. As a result, oil pressure in the engine 10 may be improved, and oil temperature in the engine 10 may be reduced. In addition, reduced oil aeration reduces stress on moving components of the engine 10, such as crankshaft, camshaft and bearing surfaces.

Third, the oil pan 24 may provide significant cost savings. Because the oil pan 24 effectively removes entrained oil from crankshaft windage, as mentioned above, additional oil scrapers and associated fasteners for fastening such oil scrapers to main bearing caps may be eliminated. Furthermore, because the oil pan 24 allows more oil to collect in the deep portion 34, as compared with prior oil pans, the need for a horizontal baffle above the deep portion 34 is effectively eliminated. The oil pan 24 may, however, be provided with such a horizontal baffle if desired for a particular application.

The operational benefits of the oil pan 24 may be especially advantageous at relatively high engine speeds, such as 5,000 revolutions per minute (rpm) or higher. The inventor has recognized that prior engines may experience oil starvation at such engine speeds, due to oil becoming entrained in crankshaft windage and due to crankshaft windage forcing oil upwardly in cylinder block drain passages. The oil pan 24 effectively addresses each of these windage-induced problems so as to enable the engine 10 to operate at engine speeds of 5,000 rpm and higher.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An engine comprising:

a rotatable crankshaft that produces crankshaft windage;

a cylinder block forming at least one cylinder bore, with the crankshaft positioned partially within the bore, and the cylinder block having drain passages formed therein with discharge openings formed in a lower face of the cylinder block;

an oil pan disposed beneath the crankshaft, the oil pan including a pan body for receiving oil that is exhausted from the crankshaft, and first and second vertically extending baffles attached to the pan body to form first and second channels which are vertically aligned with the drain passages, wherein the first baffle is adapted to scrape oil from crankshaft windage associated with the crankshaft, wherein said baffles have distal ends which are substantially coplanar with the discharge openings and the second baffle is configured to shield oil in one of the drain passages from crankshaft windage associated with the crankshaft.

2. The engine of claim 1 wherein the baffles are integrally formed with the pan body.

3. The engine of claim 2 wherein the pan body includes a floor and side walls that cooperate with the floor to define a shallow portion and a deep portion, and wherein the baffles are disposed at least partially in the shallow portion.

4. An engine comprising:

a cylinder block forming at least one cylinder bore, with the crankshaft positioned partially within the bore, and the cylinder block having drain passages formed therein with discharge openings formed in a lower face of the cylinder block;

a crankshaft that is rotatable with respect to the cylinder block, the crankshaft producing crankshaft windage when the crankshaft rotates;

an oil pan disposed beneath the crankshaft for receiving oil that is exhausted from the crankshaft and cylinder block, the oil pan including a pan body having a floor and side walls that cooperate with the floor to define a shallow portion and a deep portion in fluid communication with the shallow portion, the oil pan further including first and second vertically extending baffles disposed at least partially in the shallow portion of the pan body and attached to the floor, the baffles being spaced apart from each other so as to define first and second outer channels vertically aligned with the drain passages and an inner channel disposed between the outer channels, the first baffle being configured to scrape oil from the crankshaft windage, the second baffle being configured to sufficiently inhibit crankshaft windage from entering the drain passage of the cylinder block such that oil in the drain passage may drain into the second outer channel, the second baffle further being configured to shield oil in the second outer channel from the crankshaft windage, wherein said baffles have distal ends which are substantially coplanar with the lower face of the cylinder block.

5. The engine of claim 4 wherein the first baffle is further configured to inhibit oil in the first channel from becoming entrained in the crankshaft windage, and the engine is further characterized by the absence of a baffle plate between the oil pan and cylinder block.

* * * * *